US006616422B2

(12) United States Patent
Hsieh

(10) Patent No.: US 6,616,422 B2
(45) Date of Patent: Sep. 9, 2003

(54) COOLING FAN DUST STRUCTURE FOR KEEPING OFF FLYING DUST FROM ENTERING INTO SPINDLE

(75) Inventor: Hsin Mao Hsieh, Taipei (TW)

(73) Assignee: Adda Corporation, Ping-Tung (TW)

( * ) Notice: Subject to any disclaimer, the term of this patent is extended or adjusted under 35 U.S.C. 154(b) by 0 days.

(21) Appl. No.: 09/972,632

(22) Filed: Oct. 9, 2001

(65) Prior Publication Data

US 2003/0068238 A1 Apr. 10, 2003

(51) Int. Cl.[7] ..... F04B 35/04

(52) U.S. Cl. ..... 417/354; 417/423.1; 417/423.12; 417/423.9; 415/230; 415/220; 415/421.2

(58) Field of Search ..... 417/423.1, 423.12, 417/423.9, 354; 415/230, 220, 224, 421.2

(56) References Cited

U.S. PATENT DOCUMENTS

| | | | | |
|---|---|---|---|---|
| 5,650,678 A | * | 7/1997 | Yokozawa et al. | 310/90 |
| 5,947,704 A | * | 9/1999 | Hsieh | 417/423.12 |
| 6,010,318 A | * | 1/2000 | Li | 417/423.13 |
| 6,270,325 B1 | * | 8/2001 | Hsieh | 417/423.12 |
| 6,551,074 B2 | * | 4/2003 | Kudo et al. | 417/354 |
| 2002/0025261 A1 | * | 2/2002 | Kudo et al. | 417/354 |

* cited by examiner

*Primary Examiner*—Charles G. Freay
*Assistant Examiner*—Emmanuel Sayoc
(74) *Attorney, Agent, or Firm*—Leong C. Lei

(57) ABSTRACT

A cooling fan dust structure has provided on the end of the fan blade hood a recess that mutually forms an overcut height difference with a flange protruding from the peripheral of a motor base so to prevent the airflow carrying dust an easy ingression and even keep off the flying dust from entering into the spindle as the fan blade unit rotates.

1 Claim, 3 Drawing Sheets

COOLING FAN DUST STRUCTURE FOR KEEPING OFF FLYING DUST FROM ENTERING INTO SPINDLE

BACKGROUND OF THE INVENTION (a) Field of the Invention

The present invention is related to a cooling fan dust guard, and more particularly, to one that prevents the airflow carrying dust an easy ingression and even keeps off the flying dust from entering into the spindle.

(b) Description of the Prior Art

A cooling fan is usually adapted to a motor. Though providing simple function, the cooling fan plays a very important role in cooling for the entire system. Upon the machine is started, the cooling fan is required to maintain long term operation. Since the cooling fan is essentially working on the spindle and the bearing that are two relatively mobile parts in the system, extra care is required for the interface between said two parts, which must be kept properly lubricated and without ingression of foreign matters to warrant longer service life for the cooling fan, and further for product assurance.

As illustrated in FIG. 1, a cooling fan of the prior art is essentially comprised of a fan blade unit (a) integrated with a stator coil unit (b), a circuit board (c) and a frame (d). Wherein, a spindle (a1) from the center of the fan blade unit (a) passes through a bearing (b1) at the center of the stator coil (b) to constitute a cooling fan as illustrated in FIG. 2. When the cooling fan rotates, the spindle (a1) engages in motion relatively to that of the bearing (b1). However, under long-term dynamic operation, the cooling fan is vulnerable to permit ingression the airflow carrying dust to fall on the gap between the spindle (a1) and the bearing (b1) to damage lubricity of the spindle (1*a*), then the spindle (1*a*) becomes slower, creates higher level of noise, and in serious case, and rendered inoperative due to jammed axis of the blade.

SUMMARY OF THE INVENTION

The primary purpose of the present invention is to provide a cooling fan dust structure that prevents easy ingression of airflow carrying dust, and even keeps off the flying dust to fall on the spindle when the unit of fan blade is rotating. To achieve the purpose, a recess is provided on the end of the fan blade hood and a flange is provided on the peripheral of a motor base for both when assembled to create an overcut height difference.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
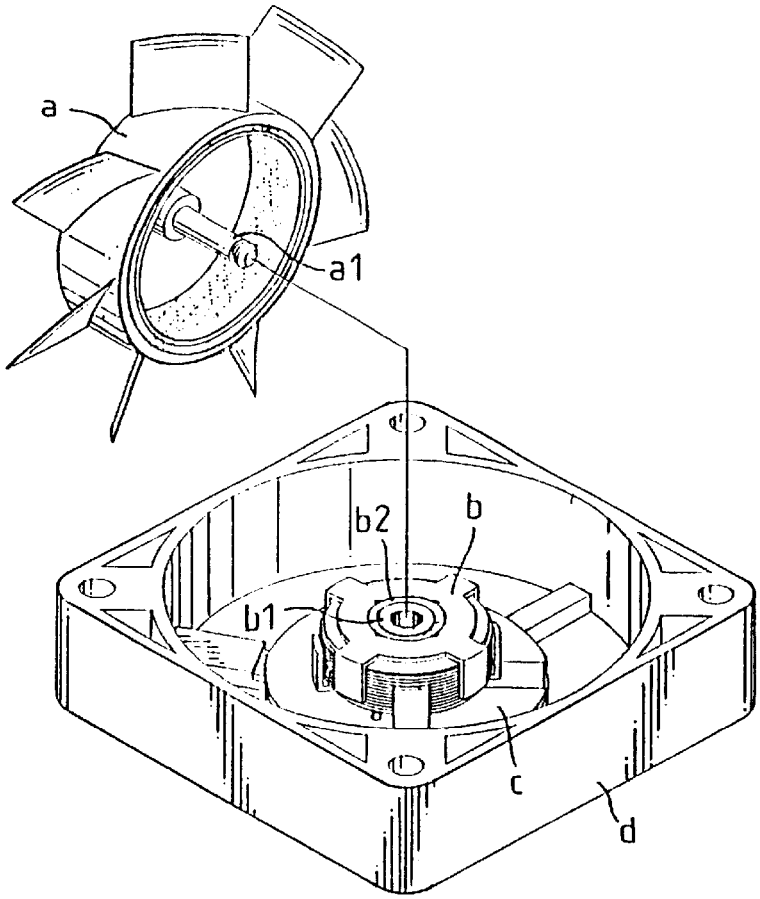
PRIOR ART FIG. 1
FIG. 1 is a view of a structure of a cooling fan of the prior art.
Figure 2:
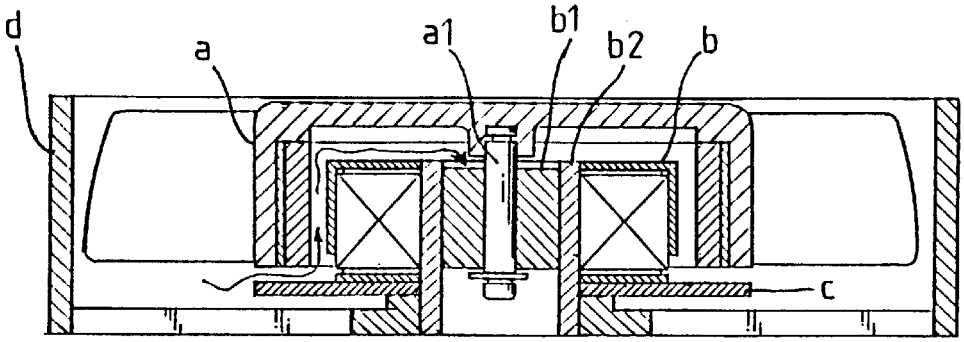
PRIOR ART FIG. 2
FIG. 2 is a sectional view of the cooling fan of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 3:
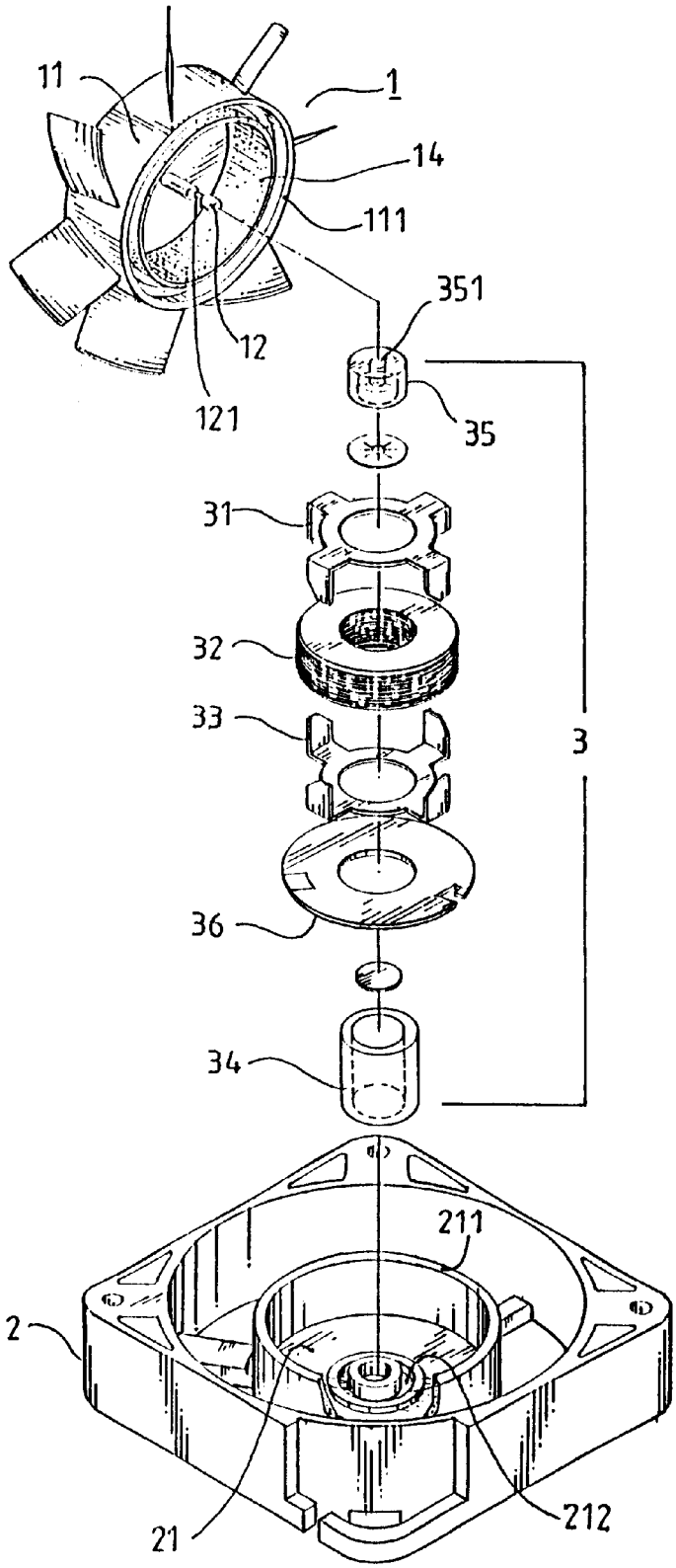
FIG. 3 is an exploded view of a structure of a cooling fan of a preferred embodiment of the present invention.

Referring to FIG. 3, a cooling fan dust structure of the present invention is essentially comprised of a fan blade unit (1), a frame (2), and a stator assembly (3), within, a circular motor base (21) being provided at the center of the frame (2), a flange (211) protruding from the peripheral of the motor base (21), a fixation base (212) formed by two flanges concentrically arranged in the motor base (21) in different diameters being provided for the stator assembly (3) to fix the stator assembly (3) in position, a bearing bushing (34) in the stator assembly (3), a bearing (35) in the bearing bushing (34), and a through hole (351) being formed on the end surface of the bearing (35) to allow insertion of a latching bit (15) through a spindle (12) of the fan blade unit (1) to engage a collar (121) of the spindle (12).

Figure 4:
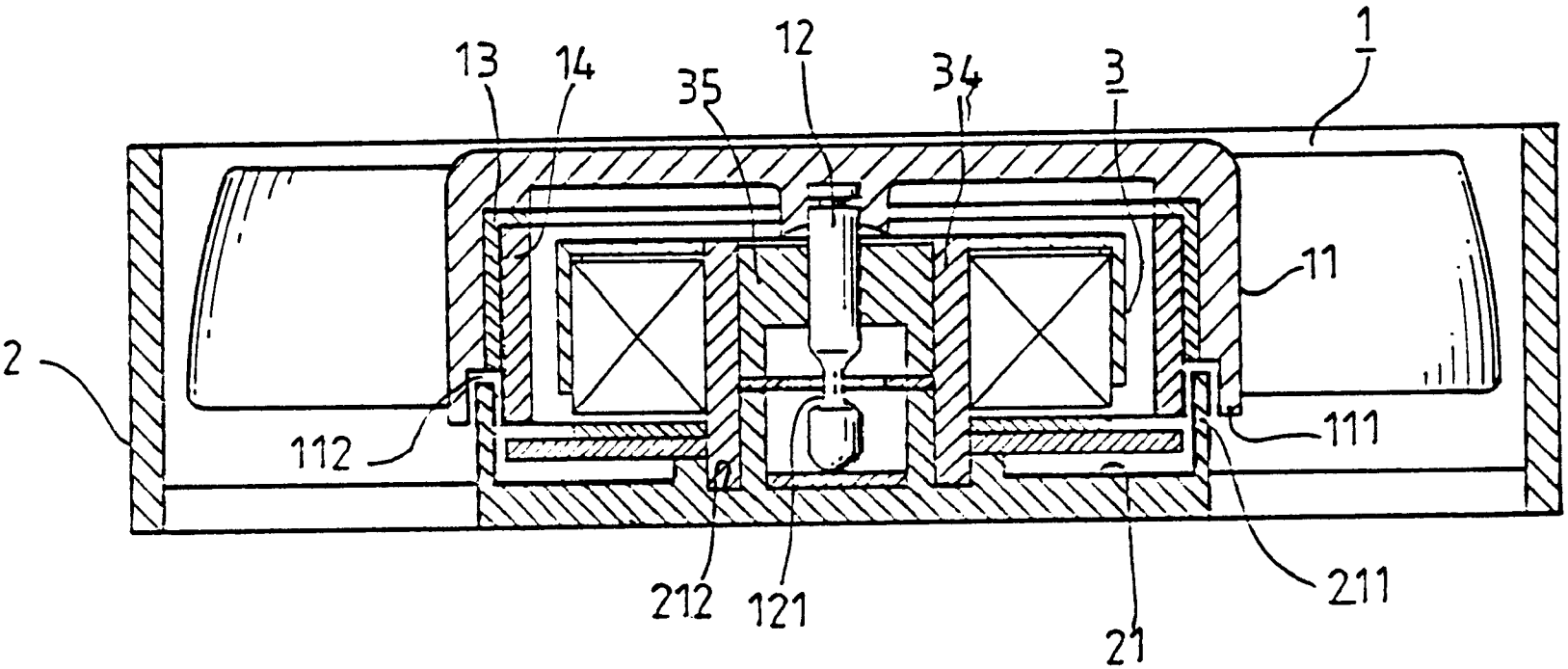
FIG. 4 is a sectional view of the preferred embodiment of the present invention.

The fan blade unit (1) when driven creates airflow and the spindle (12) extends from the center of the inner surface of the fan blade unit (1). A motor casing (13) and a permanent magnet (14) are provided on the inner edge of the fan blade unit (1). As illustrated in FIG. 4, between a hood (11) of the fan blade unit (1) and the permanent magnet (14), a recess (112) in proper depth, and a width slightly greater than that of the flange (211) is inwardly provided at the hood end (111) facing the hood (11).

The bearing (35) connected to the spindle (12) is placed in the bearing bushing (34) at the center of the stator assembly (3). Meanwhile, the flange (211) protruding from the edge of the motor base (21) is merely located in the recess (112) at the hood end (111) without contacting the recess (112) for the flange (211) and the recess (112) to form an overcut height difference to increase the length of the route for the airflow, preventing an easy ingression of the airflow carrying dust into the spindle (1) during the rotation of the fan blade unit.

The present invention for providing the flange on the peripheral of the motor base to create an overcut height difference with the recess when the flange is in the recess when assembled so to prevent easy ingression of flying dust to fall on the spindle to damage the lubricity at the free end of the spindle for effective stopping the dust, and permitting easy production from clearly defined and compact members, complies with industrial requirements. Therefore, this application is duly filed accordingly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cooling fan dust structure comprising a fan blade unit, a frame, and a stator assembly, wherein a circular motor base is provided at a center of the frame, a flange protruding from a base surface of the motor base, a fixation base being positioned in a cavity of the motor base to fix the stator assembly in position, a spindle extending from a center of an inner surface of the fan blade unit, a recess formed between a hood of the fan blade unit and a permanent magnet, said recess having a width greater than that of a flange extending from said motor base toward said hood, and a bearing connected to the spindle being placed into a bearing bushing provided at a center of the stator assembly to constitute the cooling fan, the flange protruding from the base surface of the motor base is located in the recess without contacting the recess to form an overcut height difference to increase length of a route for an airflow, thereby preventing an easy ingression of the airflow carrying dust into the spindle during rotation of the fan blade unit.

* * * * *